US007040222B2

(12) United States Patent
Nakamura et al.

(10) Patent No.: US 7,040,222 B2
(45) Date of Patent: May 9, 2006

(54) STENCIL PRINTING MACHINE

(75) Inventors: Akira Nakamura, Ibaraki-ken (JP); Taku Naitou, Ibaraki-ken (JP); Takuya Shibahara, Ibaraki-ken (JP); Yoshihiro Hayashi, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 11/039,833

(22) Filed: Jan. 24, 2005

(65) Prior Publication Data

US 2005/0160926 A1 Jul. 28, 2005

(30) Foreign Application Priority Data

Jan. 26, 2004 (JP) ..... P2004-017027

(51) Int. Cl.
*B41L 13/18* (2006.01)
*B41L 13/04* (2006.01)

(52) U.S. Cl. ..... 101/119; 101/116

(58) Field of Classification Search ..... 101/114, 101/116, 119, 120, 123, 124, 129
See application file for complete search history.

(56) References Cited

U.S. PATENT DOCUMENTS 3,994,220 A * 11/1976 Vertegaal ..... 101/119
6,789,472 B1 * 9/2004 Nakamura et al. ..... 101/119

FOREIGN PATENT DOCUMENTS

| | | |
|---|---|---|
| DE | 237 491 C | 9/1911 |
| EP | 594 195 A | 11/1947 |
| JP | 07-132675 | 5/1995 |
| JP | 2001-246828 | 9/2001 |

* cited by examiner

*Primary Examiner*—Leslie J. Evanisko
(74) *Attorney, Agent, or Firm*—Nath & Associates PLLC; Gregory B. Kang; Teresa M. Arroyo

(57) ABSTRACT

A stencil printing machine includes: a drum which is freely rotatable and has an outer peripheral wall formed of an ink impermeable member, in which a stencil sheet is mounted on a surface of the outer peripheral wall; an ink supply device which has an ink supply port on the outer peripheral wall of the drum, and supplies ink to the surface of the outer peripheral wall from the ink supply port; a pressure roller which presses a print medium fed thereto to the outer peripheral wall; and a first cap device capable of closing the ink supply port. Moreover, the stencil printing machine further includes: an ink return device which has an ink return port on the outer peripheral wall, and returns the ink which flows into the ink return port; and a second cap device capable of closing the ink return port.

7 Claims, 8 Drawing Sheets

STENCIL PRINTING MACHINE

BACKGROUND OF THE INVENTION

1. Field of the Invention

The present invention relates to a stencil printing machine which conveys a print medium while pressing the print medium to a drum on which a stencil sheet is mounted, and transfers ink oozing from perforations of the stencil sheet onto the print medium.

2. Description of the Related Art

As a conventional printing method of a stencil printing machine, there are an inner press method (refer to Japanese Patent Laid-Open Publication No. Hei 7-132675 (published in 1995)) and an outer press method (refer to Japanese Patent Laid-Open Publication No. 2001-246828).

The inner press method is briefly described. As shown in FIG. 1, a drum 100 and a back press roller 101 are provided, and the drum 100 and the back press roller 101 are provided so as to be freely rotatable in a state where outer peripheral surfaces thereof are partially made substantially adjacent to each other. A stencil clamping portion 100*a* which clamps a tip end of a stencil sheet 104 is provided on the outer peripheral surface of the drum 100, and an outer peripheral wall other than the stencil clamping portion 100*a* is formed of a screen 102 which is flexible and ink permeable.

An ink supply mechanism 105 is provided inside the drum 100. As shown in FIG. 2, this ink supply mechanism 105 includes an inner press roller 106 which is an ink supply roller, and the inner press roller 106 is provided on a roller support member 107 so as to be freely rotatable. The inner press roller 106 is configured to be shiftable between a press position where the roller support member 107 is energized in a direction of an arrow a of FIG. 2 to press an inner peripheral surface of the screen 102 and a standby position where the roller support member 107 is rotated in a direction of an arrow b of FIG. 2 to be spaced from the inner peripheral surface of the screen 102. The inner press roller 106 is set at the press position when a print sheet 111 passes therethrough, and otherwise, set at the standby position. Moreover, the inner press roller 106 has a function to apply printing pressure from an inner periphery side of the screen 102.

The roller support member 107 is supported so as to be freely rotatable about a support shaft 108, and a doctor roller 109 and a drive rod 110 are individually provided on the roller support member 107. The doctor roller 109 has a cylindrical shape, and is fixed to the roller support member 107 at a position close to the inner press roller 106. The drive rod 110 is supported on the roller support member 107 so as to be freely rotatable, and is placed in an upper space composed of outer peripheral surfaces of the inner press roller 106 and the doctor roller 109 on sides thereof adjacent to each other. Ink 103 is supplied from an ink supply unit (not shown) to the upper space.

Next, printing operations are schematically described in order. The stencil sheet 104 on which a perforated image is formed is attached onto an outer peripheral surface of the screen 102. Then, during a printing mode, the drum 100 and the back press roller 101 are rotated in synchronization with each other in directions shown in arrows in FIG. 1, and the print sheet 111 is conveyed between the drum 100 and the back press roller 101.

When the print sheet 111 is fed, the inner press roller 106 presses the screen 102, and the inner press roller 106 rotates following the drum 100 in such a pressing state. The ink 103 having passed through a gap between the inner press roller 106 and the doctor roller 109 is adhered onto the outer peripheral surface of the inner press roller 106, and the ink 103 thus adhered is sequentially supplied to an inner surface of the screen 102 by the rotation of the inner press roller 106.

Moreover, when the inner press roller 106 presses the screen 102, the screen 102 swells out to the outer periphery side thereof by pressing force at this time, and the screen 102 is put into a press-contact state with the back press roller 101. Then, the print sheet 111 conveyed between the drum 100 and the back press roller 101 is conveyed while being brought into press contact with the screen 102 and the stencil sheet 104 in between the inner press roller 106 and the back press roller 101. By press-contact force at this time, the ink 103 on the screen 102 side is transferred to the print sheet 111 from perforations of the stencil sheet 104, and an ink image is printed on the print sheet 111.

The outer press method is briefly described. As shown in FIG. 3, a drum 120 is provided. A stencil clamping portion 120*a* which clamps the tip end of the stencil sheet 104 is provided on an outer peripheral surface of this drum 120, and an outer peripheral wall 120*b* other than the stencil clamping portion 120*a* is formed of an ink permeable member with a porous structure.

An ink supply mechanism 125 is provided inside the drum 120. The ink supply mechanism 125 includes a squeegee roller 126 supported so as to be freely rotatable, and a doctor roller 127 placed adjacent to the squeegee roller 126. Ink 128 accumulates in an outer peripheral space surrounded by the squeegee roller 126 and the doctor roller 127. The ink 128 adhered onto the outer periphery of the rotating squeegee roller 126 passes through a gap between the squeegee roller 126 and the doctor roller 127, and thus only the ink 128 with a predetermined film thickness is adhered onto the squeegee roller 126, and the ink 128 with the predetermined film thickness is supplied to an inner surface of the outer peripheral wall 120*b*.

Moreover, a pressure roller 130 is provided at a position opposite to the squeegee roller 126, which is also an outside position of the drum 120. The pressure roller 130 is configured to be shiftable between a press position of pressing the outer peripheral wall 120*b* of the drum 120 and a standby position of being spaced from the outer peripheral wall 120*b* of the drum 120. The squeegee roller 126 is fixed to a support member which supports the outer peripheral wall 120*b* of the drum 120 so as to be freely rotatable, and an outer peripheral surface of the squeegee roller 126 and the inner peripheral surface of the outer peripheral wall 120*b* of the drum 120 are brought into a state of being slightly spaced from one another in a state where the outer peripheral wall 120*b* of the drum 120 is not pressed by the pressure roller 130. When the outer peripheral wall 120*b* of the drum 120 is pressed by the pressure roller 130, the outer peripheral wall 120*b* of the drum 120 is bent, and thus the outer peripheral surface of the squeegee roller 126 and the inner peripheral surface of the outer peripheral wall 120*b* of the drum 120 are brought into contact with each other.

Next, printing operations are schematically described in order. The stencil sheet 104 on which the perforated image is formed is attached onto an outer peripheral surface of the outer peripheral wall 120*b* of the drum 120. Then, during the printing mode, the outer peripheral wall 120*b* of the drum 120 is rotated in a direction shown by an arrow in FIG. 3, and the print sheet 111 is fed between the drum 120 and the pressure roller 130.

When the print sheet 111 is fed, the pressure roller 130 presses the outer peripheral wall 120*b* of the drum 120, and the outer peripheral wall 120*b* is shifted toward an inner periphery side thereof. The outer peripheral wall 120*b* is brought into a pressed state on the squeegee roller 126 by such shifting, and the squeegee roller 126 rotates following the drum 120. Onto the outer peripheral surface of the squeegee roller 126, the ink 128 having passed through the gap between the squeegee roller 126 and the doctor roller 127 is adhered. The ink 128 thus adhered is sequentially supplied to an inner surface of the outer peripheral wall 120*b* by the rotation of the squeegee roller 126.

Moreover, when the pressure roller 130 presses the outer peripheral wall 120*b* of the drum 120, the print sheet 111 conveyed between the drum 120 and the pressure roller 130 is conveyed while being brought into press contact with the stencil sheet 104 in between the squeegee roller 126 and the pressure roller 130. By press-contact force at this time, the ink 128 on the outer peripheral wall 120*b* side is transferred to the print sheet 111 side from the perforations of the stencil sheet 104, and an ink image is printed on the print sheet 111.

Incidentally, in the stencil printing machines of the conventional inner press method and outer press method, ink pools are individually formed in the outer peripheral space of the inner press roller 106 and the doctor roller 109 and in the outer peripheral space of the squeegee roller 126 and the doctor roller 127, and the inks 103 and 128 in the ink pools are supplied to the screen 102 and outer peripheral wall 120*b* of the drums 100 and 120 at the time of printing. Hence, when the printing is not performed for a long time, the inks 103 and 128 having accumulated in the ink pools and the inks 103 and 128 adhered onto the drums 100 and 120 and the like will be left standing in a state of being in contact with the atmosphere, which has caused a problem of degradation of the inks 103 and 128.

SUMMARY OF THE INVENTION

In this connection, the applicant of the present invention has proposed a stencil printing machine, which includes: a drum which is freely rotatable and has an outer peripheral wall formed of an ink impermeable member, in which a stencil sheet is mounted on a surface of the outer peripheral wall; an ink supply device which has an ink supply port on the outer peripheral wall of the drum, and supplies ink to the surface of the outer peripheral wall from the ink supply port; and a pressure roller which presses a print medium fed thereto to the outer peripheral wall. In this stencil printing machine, when the print medium is fed thereto in a state where the outer peripheral wall of the drum is rotated and the ink is supplied to the surface of the outer peripheral wall from the ink supply port, the print medium is conveyed while being pressed to the stencil sheet and the outer peripheral wall of the drum by the pressure roller. Meanwhile, the ink between the outer peripheral wall of the drum and the stencil sheet is diffused downstream in a printing direction while being squeezed. Moreover, the ink thus diffused oozes out of perforations of the stencil sheet to be transferred to the print medium side, and an ink image is printed on the print medium. Accordingly, the ink supplied to the drum is held in a substantially enclosed space between the outer peripheral wall of the drum and the stencil sheet, and is restricted from being brought into contact with the atmosphere as much as possible. Hence, degradation of the ink can be prevented as much as possible even if the printing is not performed for a long time.

However, in the stencil printing machine described above, the ink supply port is open to the outer peripheral wall of the drum, and this ink supply port is not always completely protected from the contact with the atmosphere even in a state of being covered with the stencil sheet. Moreover, some ink accumulates and remains in the ink supply port even after supply of the ink is stopped. Accordingly, such possibilities cannot be denied that the ink is cured by the contact with the atmosphere to clog the ink supply port, that the ink is degraded, and so on.

In this connection, it is an object of the present invention to provide a stencil printing machine capable of restricting ink clogging of the ink supply port and the degradation of the ink in a type including the ink supply port on the outer peripheral wall of the drum.

In order to achieve the foregoing object, the present invention includes: a drum which is freely rotatable and has an outer peripheral wall formed of an ink impermeable member, in which a stencil sheet is mounted on a surface of the outer peripheral wall; an ink supply device which has an ink supply port on the outer peripheral wall of the drum, and supplies ink to the surface of the outer peripheral wall from the ink supply port; a pressure roller which presses a print medium fed thereto to the outer peripheral wall; and a first cap device which shifts between a closing position of closing the ink supply port and an opening position of opening the ink supply port.

According to the above-described configuration, when the drum is stopped, the ink supply port is closed by the first cap device, thus making it possible not to bring the ink in the ink supply port into contact with the atmosphere. Hence, ink clogging and degradation of the ink at the ink supply port can be restricted.

A preferred embodiment of the present invention may be adapted to include: an ink return device which has an ink return port on the outer peripheral wall, and returns the ink which flows into the ink return port; and a second cap device which shifts between a closing position of closing the ink return port and an opening position of opening the ink return port.

According to the above-described configuration, when the drum is stopped, the ink return port is closed by the second cap device, thus making it possible not to bring the ink in the ink return port into contact with the atmosphere. Hence, ink clogging and degradation of the ink at the ink return port can be restricted.

The first cap device may be adapted to include: a drive source fixed to a machine body side; and a first cap which shifts between a closing position of being brought into intimate contact with the surface of the outer peripheral wall by drive of the drive source and an opening position of being spaced from the surface of the outer peripheral wall toward above thereby.

According to the above-described configuration, the first cap device can be installed without involving a design change of the drum. Hence, the first cap device can be easily installed in the existing stencil printing machine.

The second cap device may be adapted to include: a drive source fixed to a machine body side; and a second cap which shifts between a closing position of being brought into intimate contact with the surface of the outer peripheral wall by drive of the drive source and an opening position of being spaced from the surface of the outer peripheral wall toward above thereby.

According to the above-described configuration, the second cap device can be installed without involving the design change of the drum. Hence, the second cap device can be easily installed in the existing stencil printing machine.

DETAILED DESCRIPTION OF THE PREFERRED EMBODIMENTS

An embodiment of the present invention is described below based on the drawings.

Figure 1:
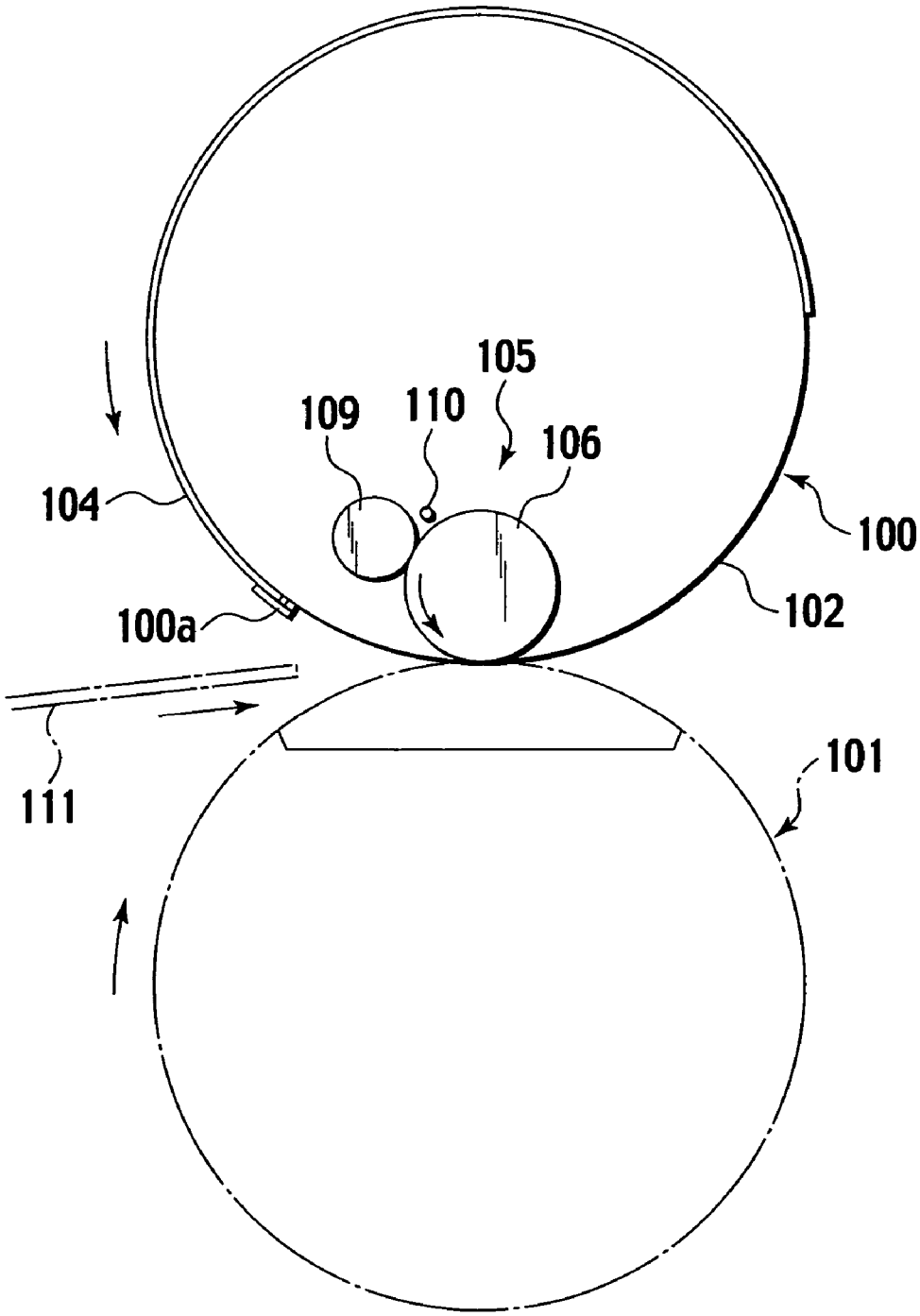
FIG.1 PRIOR ART
FIG. 1 is a schematic view of principal portions for printing according to an inner press method of a conventional example.
Figure 2:
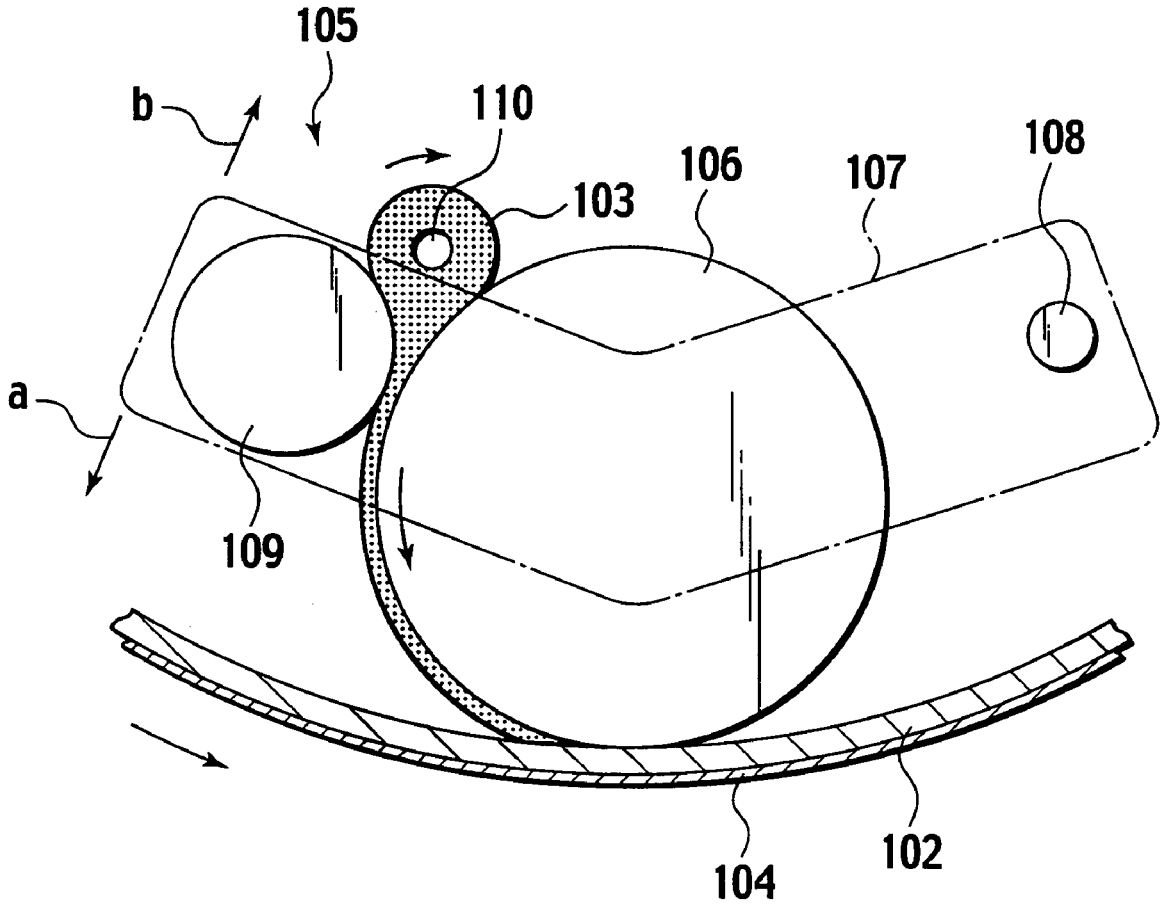
FIG.2 PRIOR ART
FIG. 2 is a schematic view of an ink supply device according to the inner press method of the conventional example.
Figure 3:
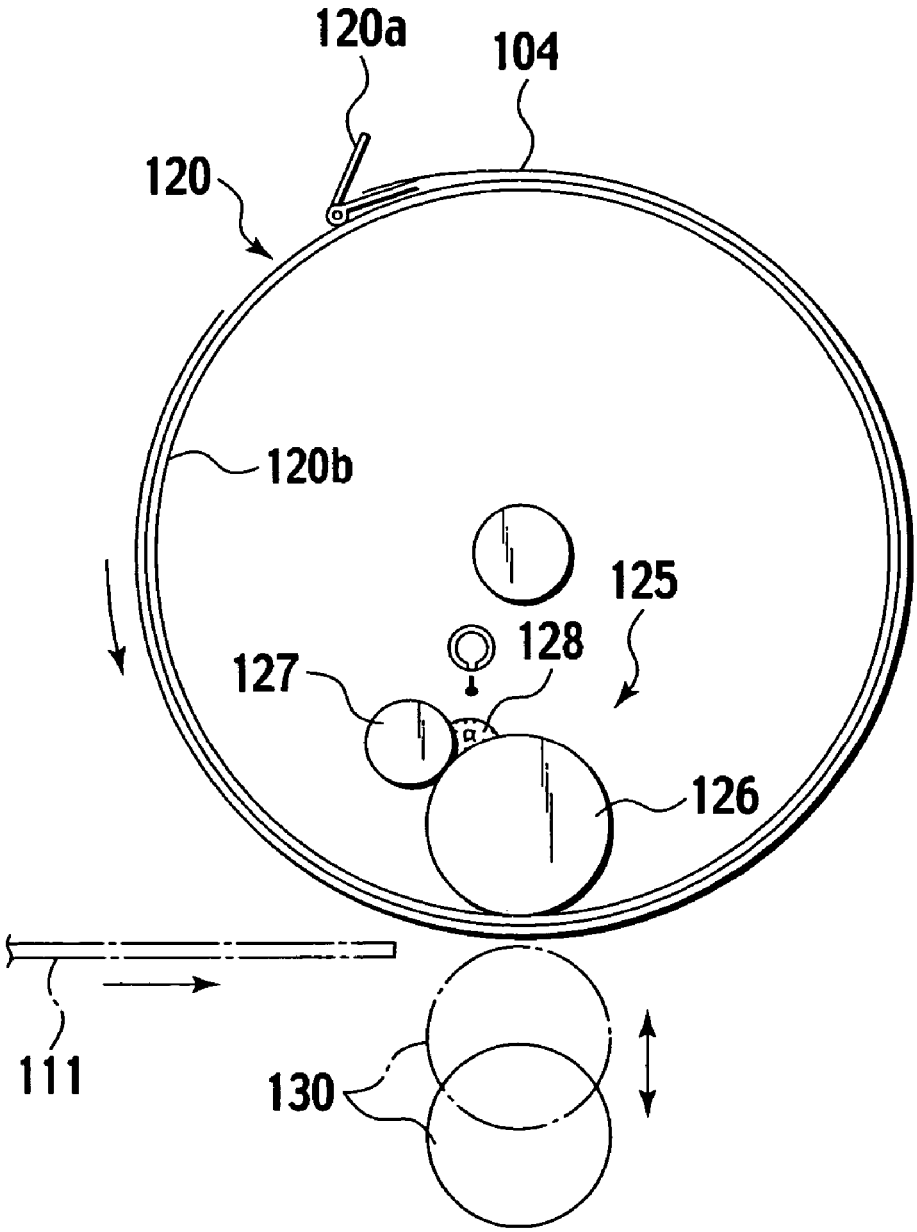
FIG.3 PRIOR ART
FIG. 3 is a schematic view of principal portions for printing according to an outer press method according to the conventional example.
Figure 4:
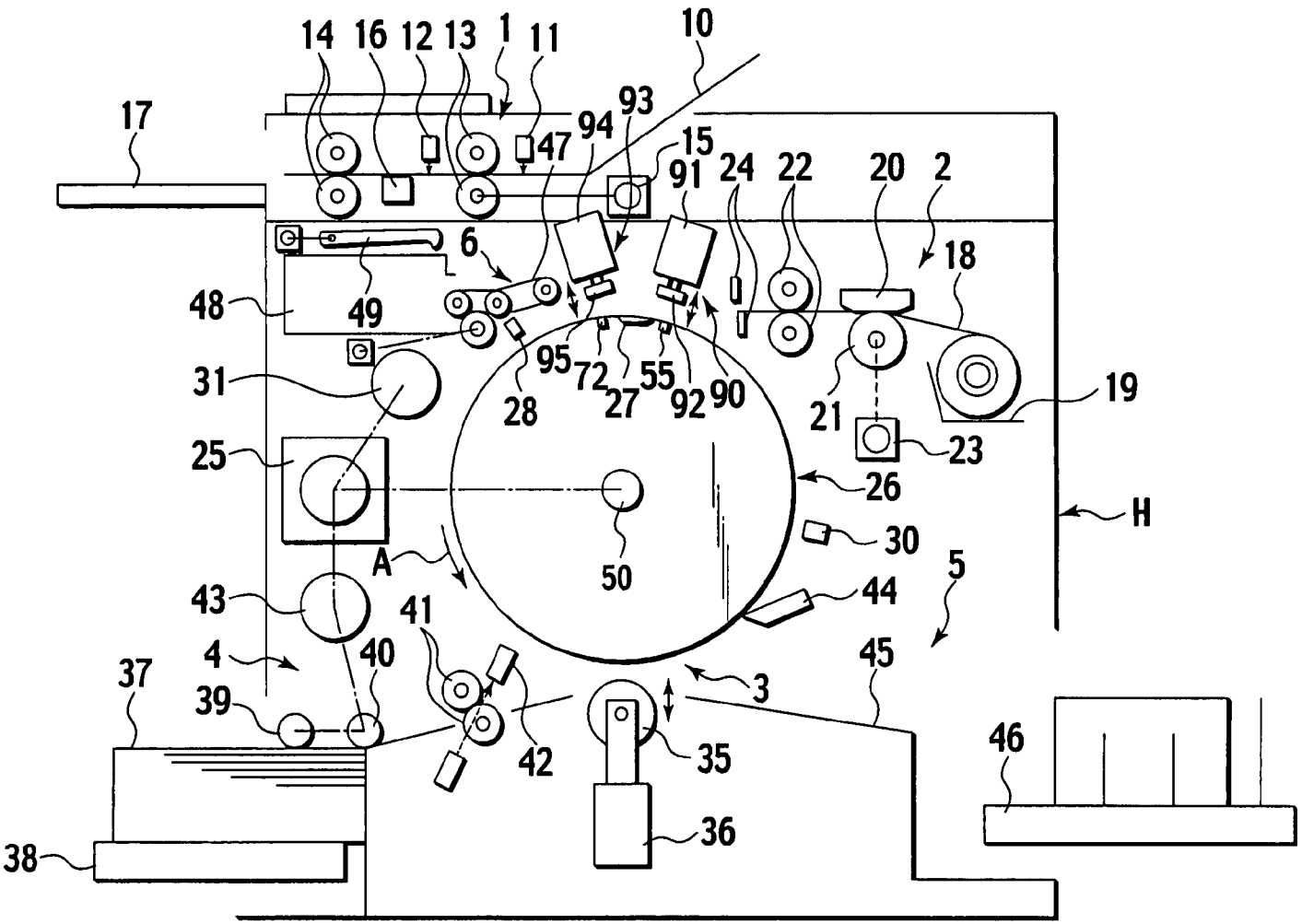
FIG. 4 shows an embodiment of the present invention, and is a schematic configuration view of a stencil printing machine.

As shown in FIG. 4, a stencil printing machine is mainly composed of an original reading unit 1, a stencil making unit 2, a printing unit 3, a paper feed unit 4, a paper discharge unit 5, and a stencil disposal unit 6.

The original reading unit 1 includes an original setting tray 10 on which an original to be printed is mounted, reflective-type original sensors 11 and 12 which detect the presence of the original on the original setting tray 10, original conveyer rollers 13 and 14 which convey the original on the original setting tray 10, a stepping motor 15 which rotationally drives the original conveyer rollers 13 and 14, a contact image sensor 16 which optically reads image data of the original conveyed by the original conveyer rollers 13 and 14 and converts the read data into electrical signals, and an original discharge tray 17 on which the original discharged from the original setting tray 10 is mounted. The original mounted on the original setting tray 10 is conveyed by the original conveyer rollers 13 and 14, and the image sensor 16 reads the image data of the conveyed original.

The stencil making unit 2 includes a stencil housing 19 which houses a long and rolled stencil sheet 18, a thermal print head 20 placed downstream of the stencil housing 19 in a conveying direction, a platen roller 21 placed at a position opposite to the thermal print head 20, a pair of stencil transfer rollers 22 and 22 placed downstream of the platen roller 21 and the thermal print head 20 in the conveying direction, a write pulse motor 23 which rotationally drives the platen roller 21 and the stencil transfer rollers 22 and 22, and a stencil cutter 24 placed downstream of the pair of stencil transfer rollers 22 and 22 in the conveying direction.

The long stencil sheet 18 is conveyed by the rotation of the platen roller 21 and the stencil transfer rollers 22 and 22. Based on the image data read by the image sensor 16, each of dot-shaped heating elements of the thermal print head 20 selectively performs a heating operation, and thus the stencil sheet 18 is perforated due to thermal sensitivity thereof to make a stencil. Then, the stencil sheet 18 thus made is cut by the stencil cutter 24 to make the stencil sheet 18 with a predetermined length.

The printing unit 3 includes a drum 26 which rotates in a direction of an arrow A of FIG. 4 by driving force of a main motor 25, a stencil clamping portion 27 which is provided on an outer peripheral surface of the drum 26 and clamps a tip end of the stencil sheet 18, an ink supply device 54 which supplies an ink to the surface of the drum 26, and an ink return device 73 which returns extra ink on the surface of the drum 26.

Moreover, the printing unit 3 includes a stencil confirming sensor 28 which detects whether or not the stencil sheet 18 is wound and attached around the outer peripheral surface of the drum 26, a reference position detecting sensor 30 which detects a reference position of the drum 26, and a rotary encoder 31 which detects rotation of the main motor 25. Based on a detection output of the reference position detecting sensor 30, a pulse outputted from the rotary encoder 31 is detected, thus enabling a rotation position of the drum 26 to be detected.

Furthermore, the printing unit 3 includes a pressure roller 35 placed below the drum 26. The pressure roller 35 is constructed to be shiftable between a press position of pressing the outer peripheral wall of the drum 26 by driving force of a solenoid device 36 and a standby position of being spaced from the outer peripheral surface of the drum 26. The pressure roller 35 is always located at the press position during a period of a printing mode (including a trial print mode) and located at the standby position during a period other than the period of the printing mode.

Then, the tip end of the stencil sheet 18 conveyed from the stencil making unit 2 is clamped by the stencil clamping portion 27, and the drum 26 is rotated in such a clamping state, so that the stencil sheet 18 is wound and attached around the outer peripheral surface of the drum 26. Then, print sheets (print media) 37, which are fed by the paper feed unit 4 in synchronization with the rotation of the drum 26, are pressed to the stencil sheet 18 wound around the drum 26 by the pressure roller 35. Thus, the ink is transferred from perforations of the stencil sheet 18 onto the print sheets 37, and an image is printed thereon.

The paper feed unit 4 includes a paper feed tray 38 on which the print sheets 37 are stacked, first paper feed rollers 39 and 40 which convey only the uppermost print sheet 37, a pair of second paper feed rollers 41 and 41 which convey the print sheet 37, which has been conveyed by the first paper feed rollers 39 and 40, between the drum 26 and the pressure roller 35 in synchronization with the rotation of the drum 26, and a paper feed sensor 42 which detects whether or not the print sheet 37 has been conveyed between the pair of second paper feed rollers 41 and 41. The first paper feed rollers 39 and 40 are constructed such that the rotation of the main motor 25 is selectively transmitted thereto through a paper feed clutch 43.

The paper discharge unit 5 includes a sheet separator claw 44 which separates the printed print sheets 37 from the drum 26, a conveying passage 45 through which the print sheets 37 separated from the drum 26 by the sheet separator claw 44 are conveyed, and a paper receiving tray 46 on which the print sheets 37 discharged from the conveying passage 45 are mounted.

The stencil disposal unit 6 includes a disposed stencil conveying device 47, a stencil disposal box 48, and a disposed stencil compression member 49. The disposed stencil conveying device 47 guides the tip end of the stencil sheet 18, of which clamping has been released from the outer peripheral surface of the drum 26, and conveys the used stencil sheet 18 thus guided while peeling off the same stencil sheet 18 from the drum 26. The stencil disposal box 48 houses the stencil sheet 18 conveyed by the disposed stencil conveying device 47. The disposed stencil compression member 49 pushes the stencil sheet 18, which has been conveyed by the disposed stencil conveying device 47 into the stencil disposal box 48, into a bottom of the stencil disposal box 48.

Next, configurations of the drum 26, the stencil clamping portion 27, the ink supply device 54 and the ink return device 73 are described.

Figure 5:
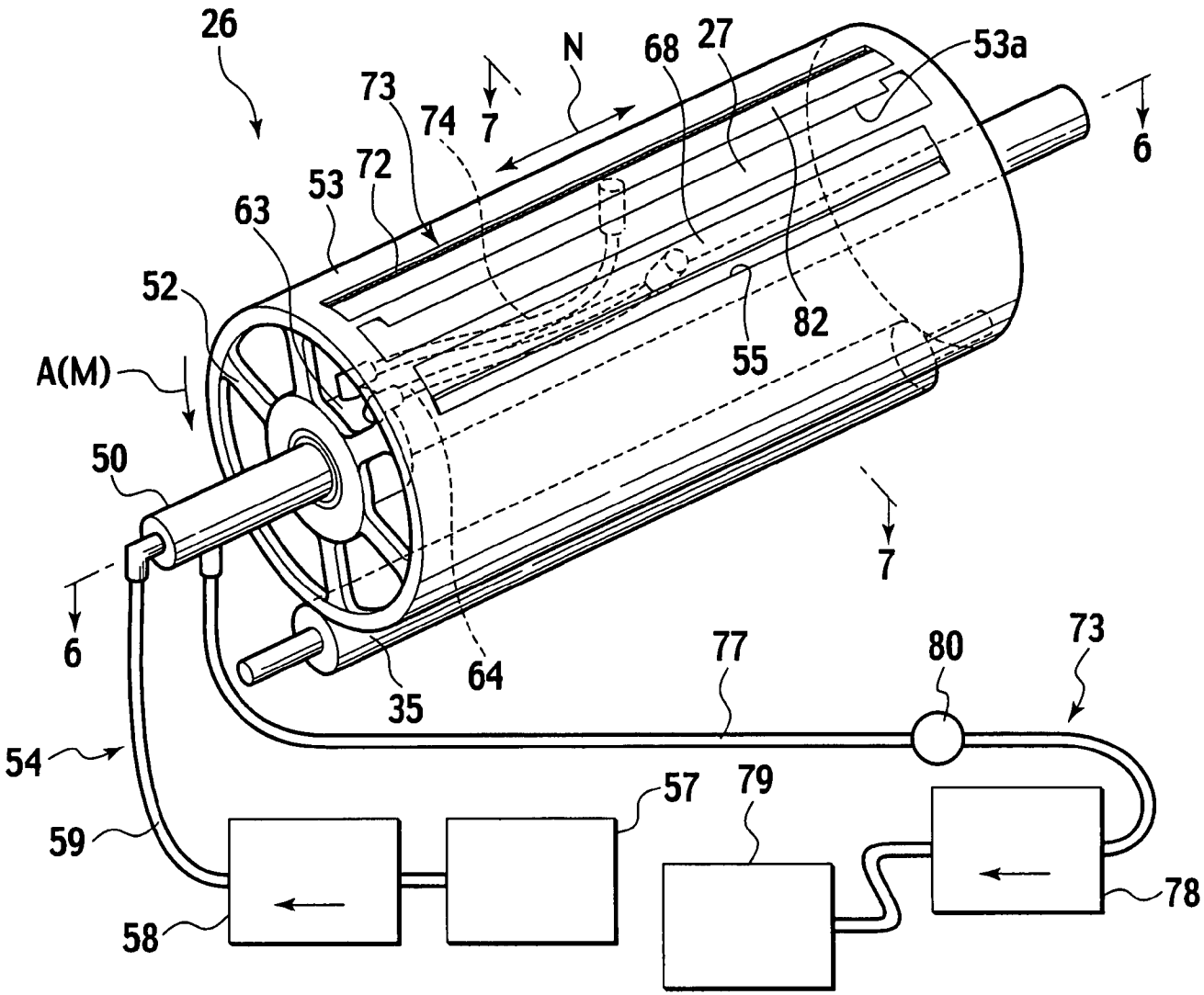
FIG. 5 shows the embodiment of the present invention, and is a perspective view of a drum.
Figure 6:
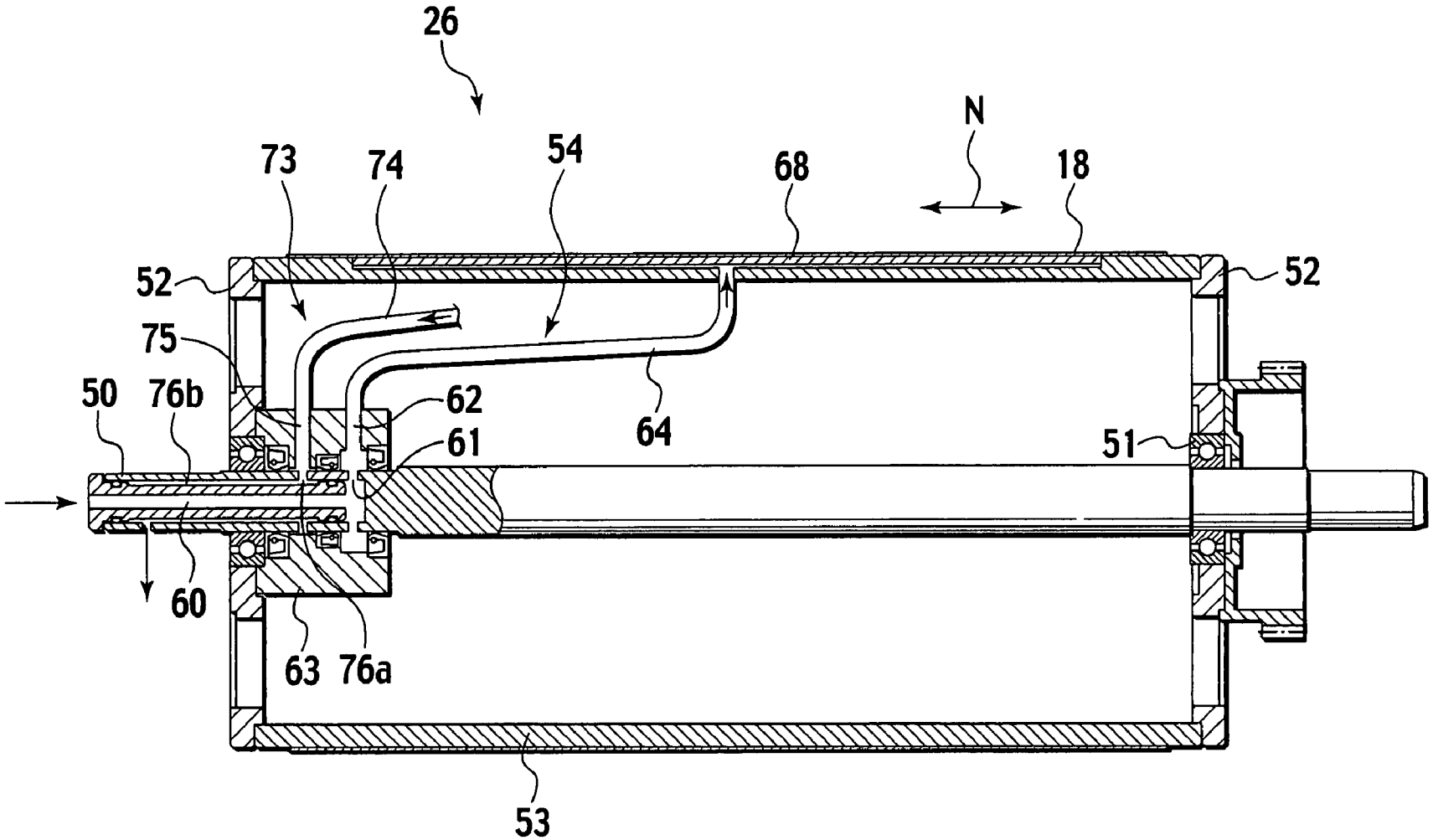
FIG. 6 shows the embodiment of the present invention, and is a cross-sectional view along a line 6—6 in FIG. 5.
Figure 7:
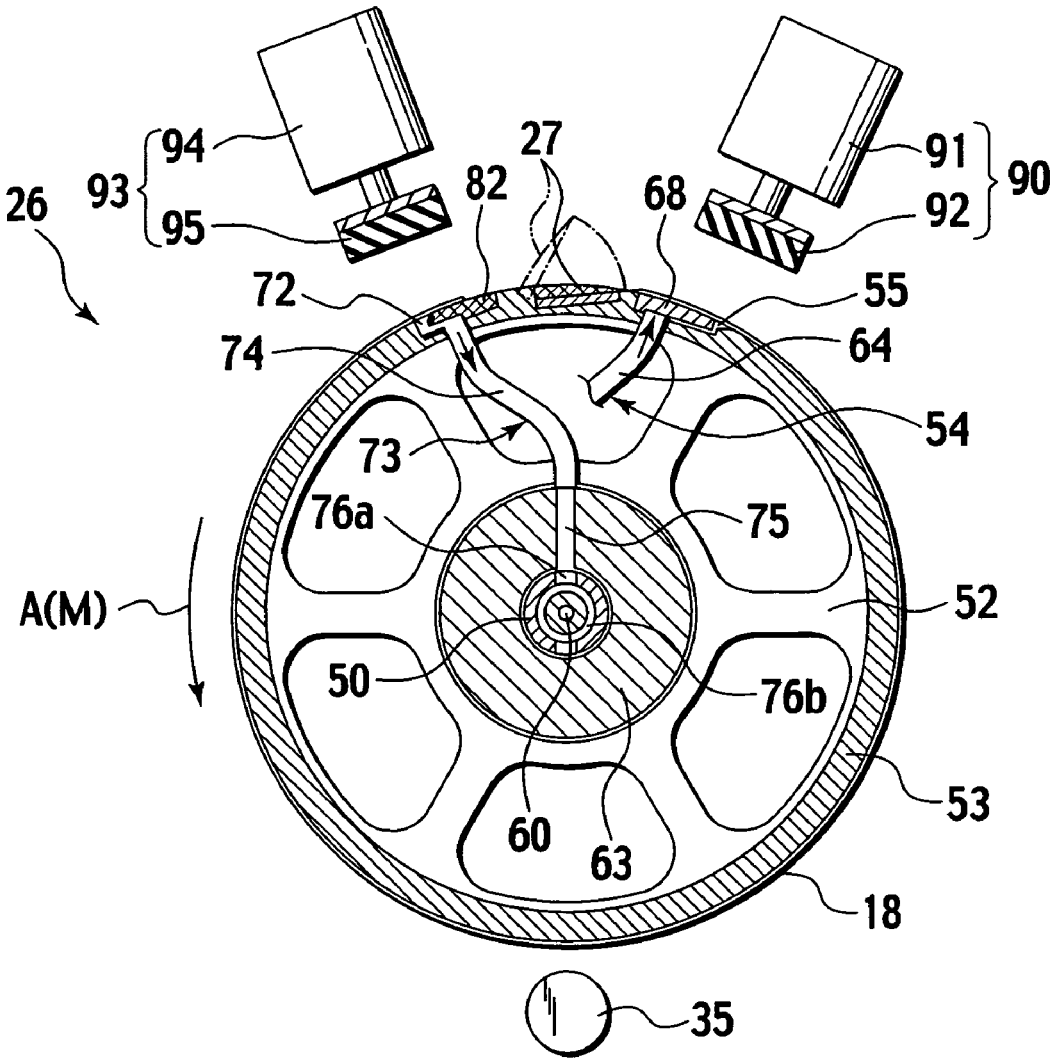
FIG. 7 shows the embodiment of the present invention, and is a cross-sectional view along a line 7—7 in FIG. 5.

As shown in FIG. 5 to FIG. 7, the drum 26 includes a support shaft 50 fixed to a machine body H, a pair of side disks 52 and 52 supported on the support shaft 50 so as to be freely rotatable with bearings 51 interposed therebetween, respectively, and a cylindrical outer peripheral wall 53 fixed between the pair of side disks 52 and 52. The outer peripheral wall 53 is rotationally driven by rotation force of the main motor 25 integrally with the pair of side disks 52 and 52. Moreover, the outer peripheral wall 53 has rigidity, and is formed of an ink impermeable member which does not allow the ink to permeate therethrough. Furthermore, the outer peripheral surface of the outer peripheral wall 53 is processed with a fluorine-contained resin coating process such as a TEFLON (registered trademark) coating process, and is formed into an even cylindrical surface.

The stencil clamping portion 27 is provided by use of a concave clamping portion 53*a* formed on the outer peripheral wall 53 along an axial direction of the support shaft 50. One end of the stencil clamping portion 27 is supported on the outer peripheral wall 53 such that the stencil clamping portion 27 is freely rotatable. The stencil clamping portion 27 is provided so as not to protrude from the outer peripheral wall 53 in a clamping state shown by a solid line in FIG. 7 while the stencil clamping portion 27 protrudes from the outer peripheral wall 53 in a clamping release state shown by a virtual line in FIG. 7. Hence, the stencil clamping portion 27 is configured to be capable of clamping the stencil sheet 18 without protruding from the outer peripheral wall 53.

The outer peripheral wall 53 is rotated in the direction of the arrow A of FIG. 5 and FIG. 7, and a position thereof rotated a little from the stencil clamping portion 27 is set at a printing start point. Hence, the rotation direction A becomes a printing direction M, and an area that follows the printing start point is set as a printing area. In this first embodiment, the maximum printing area is set at a region sufficient for printing an A3-size sheet. Moreover, an ink supply port 55 of the ink supply device 54 is provided, for example, upstream of the maximum printing area of the outer peripheral wall 53 in the printing direction M.

As shown in FIG. 5 to FIG. 7, the ink supply device 54 includes an ink container 57 in which the ink is stored, an ink pump 58 which suctions the ink in the ink container 57, a first pipe 59 which supplies the ink suctioned by the ink pump 58, the support shaft 50 to which the other end of the first pipe 59 is connected and in which an ink passage 60 is formed and a hole 61 is formed at a position 180 degrees opposite thereto, a rotary joint 63 which is supported on an outer periphery of the support shaft 50 so as to be freely rotatable and in which a through hole 62 that is able to communicate with the hole 61 is formed, a second pipe 64 in which one end thereof is connected to the rotary joint 63 and the other end thereof is guided to the outer peripheral wall 53, and the ink supply port 55 to which the other end of the second pipe 64 is connected and which is open to the surface of the outer peripheral wall 53.

The ink supply port 55 is formed by use of an ink supplying concave portion formed along a direction N perpendicular to the printing direction of the outer peripheral wall 53, and of an ink distribution member 68 formed inside the ink supplying concave portion. The ink supply port 55 is formed to be closable by a first cap device 90.

Figure 8:
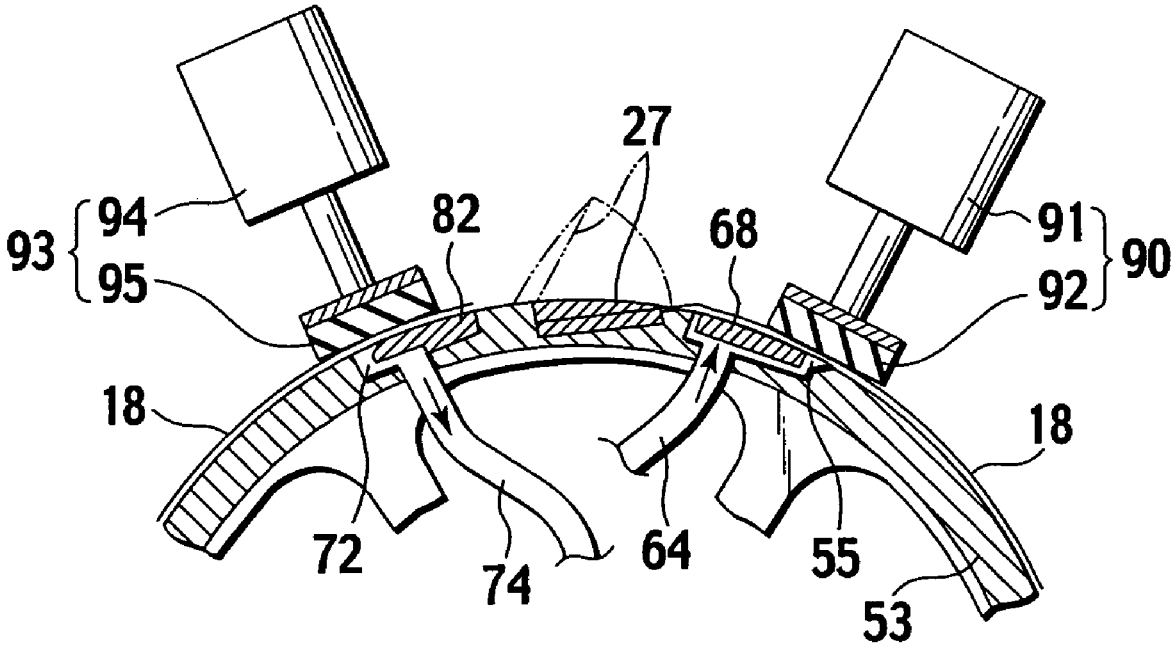
FIG. 8 shows the embodiment of the present invention, and is a partial cross-sectional view of the drum, showing a state where an ink supply port and an ink return port are closed by a first cap device and a second cap device.

As shown in FIG. 7 and FIG. 8, the first cap device 90 is composed of a solenoid unit 91 which is a drive source fixed to the machine body H side, and a first cap 92 which shifts between a closing position (position of FIG. 8) of closing the ink supply port by being brought into intimate contact with the surface of the outer peripheral wall 53 by drive of the solenoid unit 91 and an opening position (position of FIG. 7) of opening the ink supply port by being spaced from the surface of the outer peripheral wall 53 toward a position there above. The first cap 92 is formed of a rubber material good in contact characteristics, and is set at a position opposite to the ink supply port 55 with respect to the outer peripheral wall 53 located at a standby position (position of FIG. 7 and FIG. 8) for the rotation.

As shown in FIG. 5 to FIG. 7, the ink return device 73 is composed of an ink return port 72 open at a printing position, for example, downstream of the maximum printing area of the outer peripheral wall 53, a third pipe 74 in which one end is connected to the ink return port 72, the rotary joint 63 to which the other end of the third pipe 74 is connected and in which a communication hole 75 is formed, the support shaft 50, a fourth pipe 77 in which one end is connected to the support shaft 50, a filter 80 which is interposed midway through the fourth pipe 77 and traps paper powder and the like, an ink pump (for example, trochoid pump) 78 which is interposed midway through the fourth pipe 77 and suctions the ink in the fourth pipe 77, and a return container 79 to which the other end of the fourth pipe 77 is connected. Here, regarding the support shaft 50, the rotary joint 63 is supported thereon so as to be freely rotatable, a hole 76*a* to which the communication hole 75 is connectable is formed therein, and an ink passage 76*b* is formed in the inside thereof.

The ink return port 72 is formed by use of an ink returning concave portion formed along the perpendicular-to-printing direction N of the outer peripheral wall 53, and a pipe fixing member 82 placed in the inside thereof. The ink return port 72 is formed to be closable by a second cap device 93.

As shown in FIG. 7 and FIG. 8, the second cap device 93 is composed of a solenoid unit 94 which is a drive source fixed to the machine body H side, and a second cap 95 which shifts between a closing position (position of FIG. 8) of closing the ink supply port by of being brought into intimate contact with the surface of the outer peripheral wall 53 by drive of the solenoid unit 94 and an opening position (position of FIG. 7) opening the ink supply port by of being spaced from the surface of the outer peripheral wall 53 toward a position there above. The second cap 95 is formed of a rubber material good in contact characteristics, and is set at a position opposite to the ink return port 72 with respect to the outer peripheral wall 53 located at the standby position (position of FIG. 7 and FIG. 8) for the rotation.

The rotary joint 63 is made to also function as one for the ink supply device 54. Moreover, the support shaft 50 is also used as one for an ink passage of the ink supply device 54, and accordingly, adopts a structure of a double pipe.

Next, operations of the stencil printing machine are briefly described.

It is assumed that the used stencil sheet 18 is removed from the outer peripheral wall 53 of the drum 26, and that the first cap 92 of the first cap device 90 and the second cap 95 of the second cap device 93 are located at the opening positions of FIG. 7.

First, when a stencil making mode is selected, in the stencil making unit 2, the stencil sheet 18 is conveyed by the rotation of the platen roller 21 and the stencil transfer rollers 22 and 22. Based on the image data read by the original reading unit 1, a large number of heating elements of the thermal print head 20 selectively perform the heating operation, and thus the stencil sheet 18 is perforated due to the thermal sensitivity thereof to make the stencil. Then, the stencil sheet 18 thus made is cut at the predetermined spot by the stencil cutter 24. Thus, the stencil sheet 18 with the predetermined length is made.

In the printing unit 3, the tip end of the stencil sheet 18 made in the stencil making unit 2 is clamped by the stencil clamping portion 27 of the drum 26, and the drum 26 is rotated in such a clamping state, so that the stencil sheet 18 is wound, attached and loaded around the outer peripheral surface 53 of the drum 26.

Next, when the printing mode is selected, in the printing unit 3, the drum 26 is rotationally driven, and the ink supply device 54 and the ink return device 73 start driving. Then, the ink is supplied from the ink supply port 55 to the outer peripheral wall 53, and the ink thus supplied is held between the outer peripheral wall 53 and the stencil sheet 18, and the pressure roller 35 is shifted from the standby position to the press position.

The paper feed unit 4 feeds the print sheets 37 between the drum 26 and the pressure roller 35 in synchronization with the rotation of the drum 26. The print sheets 37 thus fed are pressed to the outer peripheral wall 53 of the drum 26 by the pressure roller 35, and conveyed by the rotation of the outer peripheral wall 53 of the drum 26. Specifically, the print sheets 37 are conveyed while being brought into intimate contact with the stencil sheet 18.

Moreover, at the same time when the printed sheets 37 are conveyed, the ink held between the outer peripheral wall 53 of the drum 26 and the stencil sheet 18 is diffused downstream in the printing direction M while being squeezed by the pressing force of the pressure roller 35. The ink thus diffused oozes out of the perforations of the stencil sheet 18, and is transferred to the printed sheets 37. In the manner described above, the ink image is printed on the print sheets 37 in the process where the print sheets 37 pass between the outer peripheral wall 53 of the drum 26 and the pressure roller 35. With regard to the print sheets 37 which have come out from between the outer peripheral wall 53 of the drum 26 and the pressure roller 35, the tip ends thereof are peeled off from the drum 26 by the sheet separator claw 44. The print sheets 37 separated from the drum 26 are discharged through the conveying passage 45 to the paper receiving tray 46, and are stacked there.

During the printing operations, extra ink which has flown downstream of the maximum printing area of the outer peripheral wall 53 flows into the ink return port 72 of the ink return device 73 and is returned there, and accordingly, ink leakage from the outer peripheral wall 53 is prevented.

When printing of the set number of print sheets is completed, the rotation of the drum 26 is stopped, the drum 26 is located at the standby position for the rotation, and the drive of the ink supply device 54 is stopped. Thus, the supply of the ink to the outer peripheral wall 53 is stopped. The drive of the ink return device 73 is stopped a little later than the stop of the ink supply device 54, and the extra ink which has remained on the outer peripheral wall 53 is returned through the ink return port 72. Moreover, the pressure roller 35 is returned back to the standby position from the press position. Furthermore, the solenoid units 91 and 94 of the first cap device 90 and the second cap device 93 drive to shift the first cap 92 and the second cap 95 to the respective closing positions (positions of FIG. 8), and both of the ink supply port 55 and the ink return port 72 are closed by the first cap 92 and the second cap 95. After the operations described above are completed, the stencil printing machine enters a standby mode.

During the standby mode, when making of a new stencil sheet is started and so on and a stencil disposal mode is thus selected, the solenoid units 91 and 94 of the first cap device 90 and the second cap device 93 drive to shift the first cap 92 and the second cap 95 to the respective opening positions (positions of FIG. 7), and both of the ink supply port 55 and the ink return port 72 are opened. Next, the stencil clamping portion 27 of the drum 26 is shifted to a clamping release position, and the tip end of the stencil sheet 18, of which clamping has been released, is guided to the disposed stencil conveying device 47, following the rotation of the drum 26, and housed in the stencil disposal box 48.

During the standby mode, when the printing mode is selected again, the solenoid units 91 and 94 of the first cap device 90 and the second cap device 93 drive to shift the first cap 92 and the second cap 95 to the respective opening positions (positions of FIG. 7), and both of the ink supply port 55 and the ink return port 72 are opened. Then, the stencil printing machine enters the printing operations described above.

As above, in this stencil printing machine, when the drum 26 is driven, the first cap device 90 and the second cap device 93 are located at the opening positions to enable the drum 26 to be driven, and the ink supply from the ink supply port 55 and the ink return from the ink return port 72 are made possible, thus making it possible to perform the printing operations and the like. Meanwhile, when the drum 26 is stopped, the first cap device 90 and the second cap device 93 are located at the closing positions to close the ink supply port 55 and the ink return port 72, thus making it possible not to bring the ink in the ink supply port 55 and the ink return port 72 into contact with the atmosphere. Hence, ink clogging and degradation of the ink at the ink supply port 55 and the ink return port 72 can be restricted. Moreover, the ink is always served for the printing in such a best condition of being hardly deteriorated, and accordingly, a degree of freedom in selecting the ink is increased very much.

Note that, though the first cap 92 and the second cap 95 close the ink supply port 55 and the ink return port 72 from above the stencil sheet 18, the stencil sheet 18 may be removed from the outer peripheral wall 53, and the first cap 92 and the second cap 95 may directly close the ink supply port 55 and the ink return port 72. When the stencil printing machine is not used for a long period, it is more effective to close the ink supply port 55 and the ink return port 72 directly by the first cap 92 and the second cap 95 for preventing the ink clogging and the degradation of the ink.

In the above-described embodiment, the first cap device 90 is composed of the solenoid unit 91 fixed to the machine body H side, and the first cap 92 which shifts between the closing position of closing the ink supply port by being brought into intimate contact with the surface of the outer peripheral wall 53 by the drive of the solenoid unit 91 and the opening position of opening the ink supply port by being spaced from the surface of the outer peripheral wall 53 toward a position there above. Therefore, the first cap device 90 can be installed without involving a design change of the drum 26. Hence, the first cap device 90 can be easily attached onto the existing stencil printing machine.

In the above-described embodiment, the second cap device 93 is composed of the solenoid unit 94 fixed to the machine body H side, and the second cap 95 which shifts between the closing position of closing the ink supply port by being brought into intimate contact with the surface of the outer peripheral wall 53 by the drive of the solenoid unit 94 and the opening position of opening the ink supply port by being spaced from the surface of the outer peripheral wall 53 toward a position there above. Therefore, the second cap device 93 can be installed without involving a design change of the drum 26. Hence, the second cap device 93 can be easily attached onto the existing stencil printing machine.

In the above-described embodiment, though the first cap device 90 and the second cap device 93 have the solenoid units 91 and 94, respectively, the first cap device 90 and the second cap device 93 may be configured to be shifted by a single solenoid unit because it is satisfactory if the first cap 92 and the second cap 95 are shifted at the same timing between the closing positions and the opening positions. Such a configuration achieves more reduction of parts count and cost. Moreover, the drive source may be composed of other one than the solenoid device, for example, a motor.

Moreover, in the above-described embodiment, though the first cap device 90 capable of closing the ink supply port 55 and the second cap device 93 capable of closing the ink return port 72 are provided, only the first cap device 90 may be provided. In the drum 26 in which the ink return port 72 is not provided on the outer peripheral wall 53, naturally, only the first cap device 90 is installed.

Moreover, in the above-described embodiment, though the ink return port 72 is provided at the printing position downstream of the maximum printing area of the outer peripheral wall 53, ink return grooves which communicate with the ink return port 72 may be provided on both-side positions of the maximum printing area of the outer peripheral wall 53. When the ink return grooves are provided on both sides in such a way, the ink leakage not only from the end of the outer peripheral wall 53 but also from both sides can be surely prevented. Furthermore, an ink return groove which communicates with the both-side ink return grooves may be provided at a position upstream of the maximum printing area of the outer peripheral wall 53 (position upstream of the ink supply port 55). When the ink return groove is provided on the top in such a way, ink leakage from the top can also be surely prevented.

Note that, in the above-described embodiment, though the first and second cap devices 90 and 93 are composed of the solenoid units 91 and 94 fixed to the machine body H side, and the first and second caps 92 and 95 which are provided integrally with the respective solenoid devices 91 and 94 and intimately contact and are spaced from the outer peripheral wall 53 of the drum 26, the respective solenoid devices may be provided on the machine body side, and the respective caps may be provided on the drum side. When such a mode is applied to a stencil printing machine in which a drum is set freely detachable from a machine body, the drum is capped with the respective caps even when the drum is detached therefrom, and accordingly, this mode is effective for preventing the degradation of the ink, and so on.

What is claimed is:

1. A stencil printing machine, comprising:

a drum which is freely rotatable and has an outer peripheral wall formed of an ink impermeable member, in which a stencil sheet is mounted on a surface of the outer peripheral wall;

an ink supply device which has an ink supply port on the outer peripheral wall of the drum, and supplies an ink to the surface of the outer peripheral wall from the ink supply port;

a pressure roller which presses a print medium fed thereto to the outer peripheral wall; and a first cap device which shifts between a closing position of closing the ink supply port by being brought into intimate contact with the surface of the outer peripheral wall and an opening position of opening the ink supply port by being spaced from the surface of the outer peripheral wall.

2. The stencil printing machine according to claim 1, further comprising:

an ink return device which has an ink return port on the outer peripheral wall, and returns the ink which flows into the ink return port; and a second cap device which shifts between a closing position of closing the ink return port by being brought into intimate contact with the surface of the outer peripheral wall and an opening position of opening the ink return port by being spaced from the surface of the outer peripheral wall.

3. The stencil printing machine according to claim 2, wherein the second cap device comprises:

a drive source fixed to a machine body side; and a second cap which shifts between the closing position of closing the ink return port by being brought into intimate contact with the surface of the outer peripheral wall by drive of the drive source and the opening position of opening the ink return port by being spaced from the surface of the outer peripheral wall.

4. The stencil printing machine according to claim 1, wherein the first cap device comprises:

a drive source fixed to a machine body side; and a first cap which shifts between the closing position of closing the ink supply port by being brought into intimate contact with the surface of the outer peripheral wall by drive of the drive source and the opening position of opening the ink supply port by being spaced from the surface of the outer peripheral wall.

5. A stencil printing machine, comprising:

a drum which is freely rotatable and has an outer peripheral wall formed of an ink impermeable member, in which a stencil sheet is mounted on a surface of the outer peripheral wall;

an ink supply device which has an ink supply port on the outer peripheral wall of the drum, and supplies an ink to the surface of the outer peripheral wall from the ink supply port;

a pressure roller which presses a print medium fed thereto to the outer peripheral wall;

a first cap device which shifts between a closing position of closing the ink supply port and an opening position of opening the ink supply port;

an ink return device which has an ink return port on the outer peripheral wall, and returns the ink which flows into the ink return port; and a second cap device which shifts between a closing position of closing the ink return port and an opening position of opening the ink return port.

6. The stencil printing machine according to claim 5, wherein the second cap device comprises:

a drive source fixed to a machine body side; and a second cap which shifts between the closing position of closing the ink return port by being brought into intimate contact with the surface of the outer peripheral wall by drive of the drive source and the opening position of opening the ink return port by being spaced from the surface of the outer peripheral wall.

7. A stencil printing machine, comprising:

a drum which is freely rotatable and has an outer peripheral wall formed of an ink impermeable member, in which a stencil sheet is mounted on a surface of the outer peripheral wall;

an ink supply device which has an ink supply port on the outer peripheral wall of the drum, and supplies an ink to the surface of the outer peripheral wall from the ink supply port;

a pressure roller which presses a print medium fed thereto to the outer peripheral wall; and a first cap device which shifts between a closing position of closing the ink supply port and an opening position of opening the ink supply port;

wherein the first cap device comprises:

a drive source fixed to a machine body side; and a first cap which shifts between the closing position of closing the ink supply port by being brought into intimate contact with the surface of the outer peripheral wall by drive of the drive source and the opening position of opening the ink supply port by being spaced from the surface of the outer peripheral wall.

* * * * *